US009068449B2

(12) United States Patent
Surjaatmadja

(10) Patent No.: US 9,068,449 B2
(45) Date of Patent: Jun. 30, 2015

(54) TRANSVERSE WELL PERFORATING

(71) Applicant: Halliburton Energy Services, Inc., Houston, TX (US)

(72) Inventor: Jim B. Surjaatmadja, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 303 days.

(21) Appl. No.: 13/622,086

(22) Filed: Sep. 18, 2012

(65) Prior Publication Data

US 2014/0076557 A1 Mar. 20, 2014

(51) Int. Cl.
*E21B 43/119* (2006.01)
*E21B 43/26* (2006.01)

(52) U.S. Cl.
CPC ..... *E21B 43/26* (2013.01); *E21B 43/119* (2013.01)

(58) Field of Classification Search
CPC ..... E21B 43/119; E21B 43/26
USPC ..... 166/298, 308.1, 250.1, 254.1, 55, 177.5
See application file for complete search history.

(56) References Cited

U.S. PATENT DOCUMENTS 4,194,577 A * 3/1980 Vann ..... 175/4.51
4,869,322 A * 9/1989 Vogt et al. ..... 166/280.1
4,960,171 A * 10/1990 Parrott et al. ..... 166/55
4,977,961 A * 12/1990 Avasthi ..... 166/297
5,111,881 A * 5/1992 Soliman et al. ..... 166/250.1
5,318,123 A 6/1994 Venditto et al.
5,360,066 A 11/1994 Venditto et al.
5,361,856 A 11/1994 Surjaatmadja et al.
5,386,875 A * 2/1995 Venditto et al. ..... 166/308.1
5,392,857 A * 2/1995 Behrmann ..... 166/297
5,499,678 A 3/1996 Surjaatmadja et al.
5,669,448 A 9/1997 Minthorn et al.
5,765,642 A 6/1998 Surjaatmadja
6,135,205 A 10/2000 Phillips
6,298,915 B1 * 10/2001 George ..... 166/255.2
6,386,288 B1 * 5/2002 Snider et al. ..... 166/298
6,595,290 B2 7/2003 George et al.
6,748,843 B1 * 6/2004 Barker et al. ..... 89/1.15
8,540,024 B2 * 9/2013 Kosarev et al. ..... 166/280.2
2011/0036571 A1 * 2/2011 Vitalievich et al. ..... 166/280.1
2014/0069653 A1 * 3/2014 Liu et al. ..... 166/308.1
2014/0076557 A1 * 3/2014 Surjaatmadja ..... 166/280.1

* cited by examiner

*Primary Examiner* — Jennifer H Gay

(74) *Attorney, Agent, or Firm* — Craig W. Roddy; Fish & Richardson P.C.

(57) ABSTRACT

In stimulating a subterranean zone surrounding a well bore, a perforation trajectory is identified that is transverse to a predicted direction of primary fracture propagation in the subterranean zone. A perforating gun in the well bore is aimed to perforate in the perforation trajectory, and then operated to perforate the well bore in the perforation trajectory. Thereafter, a fracture treatment is performed on the subterranean zone through the perforations.

24 Claims, 3 Drawing Sheets

TRANSVERSE WELL PERFORATING

BACKGROUND

In completing a cased well, the well is often subjected to a stimulation treatment where the well is perforated and fractured to form a primary fracture. The primary fracture extends outward from the perforations at the wellbore wall, deep into the surrounding rock. The direction of primary fracture propagation is dictated by the characteristics of the rock being fractured. Although local discontinuities can have local effects on the direction of the fracture propagation, the majority of a primary fracture will propagate in a single direction dictated by the rock. Therefore, perforations are typically formed in the predicted direction of fracture propagation, so that primary fractures formed through the perforations extend from the perforations in the same direction.

DESCRIPTION OF DRAWINGS

Like reference symbols in the various drawings indicate like elements.

DETAILED DESCRIPTION

The concepts here encompass methods of perforating and fracturing stimulating a subterranean zone of interest surrounding a wellbore, whereby the wellbore is perforated in a trajectory that is transverse to the predicted direction of primary fracture propagation. While additional perforations can be provided, the perforations transverse to the predicted direction of primary fracture propagation are intended to account for near wellbore damage and stress modification that occurs during perforating and produce primary fractures that extend in a non-tortuous path between the wellbore and the majority of the fracture that the forms in the direction of primary fracture propagation. Further, the perforations transverse to the predicted direction of primary fracture propagation cross the resulting primary fractures to ensure that the perforations communicate the fracture with the wellbore.

Figure 1:
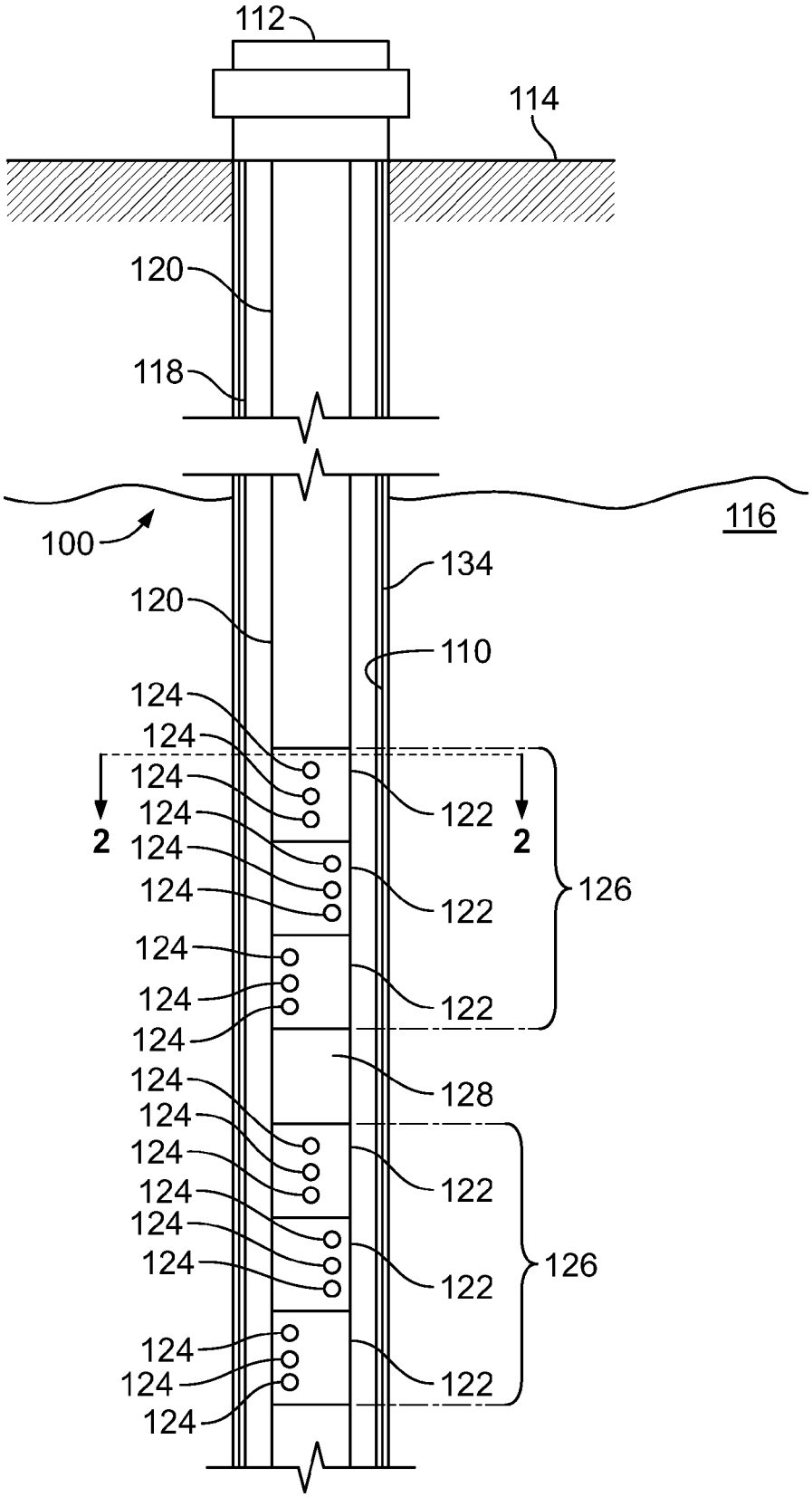
FIG. 1 is a schematic side cross-sectional view of an example well being perforated.

Referring first to FIG. 1, an example well 100 is shown prior to completion. The well 100 includes a substantially cylindrical wellbore 110 that extends from a wellhead 112 at the surface 114 downward into the Earth into one or more subterranean zones of interest 116 (one shown). A subterranean zone 116 can encompass a portion of a formation, an entire formation or part or all of multiple formations. A portion of the wellbore 110 extending from the wellhead 112 to the subterranean zone 116 is shown lined with lengths of tubing, called casing 118, that is cemented into place. In other instances, the casing 118 can be omitted or the casing can extend to the termination of the wellbore 110. Casing 118 can also represent multiple casing. The depicted well 100 is a vertical well, having a substantially vertical wellbore portion that extends from the surface 114 to the subterranean zone 116. The concepts herein, however, are applicable to many other different configurations of wells, including horizontal wells, slanted or otherwise deviated wells, and multilateral wells.

A tubing string 120 is shown as having been lowered from the surface 114 into the wellbore 110. The tubing string 120 is a tubing conveyed perforating string for perforating the wall of the wellbore (e.g., casing 118 and/or other) prior to fracturing the subterranean zone 116. The tubing string 120 can be jointed tubing coupled together and/or a continuous (i.e., not jointed) coiled tubing, and can include one or more well tools. Particularly, as a perforating string, the tubing string 120 includes one or more perforating guns 122 (six shown, but fewer or more could be provided). In other instances, the tubing string 120 can be arranged as a wireline conveyed perforating string. In the context of a wireline conveyed perforating string, the tubing string 120 does not extend from the surface 114, but rather is lowered into the well on a wire, such as a slickline, wireline, e-line and/or other wire.

In either instance, tubing conveyed or wireline conveyed, the perforating guns 122 are of a type using explosive pyrotechnic charges to perforate the wall of the wellbore 110. For convenience of reference, the perforating guns 122 are described as shaped charge perforating guns that use a shaped, explosive pyrotechnic charge that forms a highly directional, high pressure jet when detonated. The high pressure jet perforates the wall of the wellbore 110 forming a perforation tunnel extending outward from the wellbore 110 into the subterranean zone 116. However, other configurations of explosive pyrotechnic charges can be used. For example, in certain instances, the perforating guns 122 can be projectile perforating guns that use explosive pyrotechnic charges to propel projectiles to perforate the wall of the wellbore 110.

FIG. 1 shows two sets 126 of three perforating guns 122, each. In other instances, a set 126 could have fewer or more guns 122. Each gun 122 in the set 126 is shown with three explosive charges 124; however, fewer or more charges 124 could be provided in each gun 122. Although only two sets 126 is shown, the string 120 is typically provided with multiple sets 126 and could also be provided with only one set 126 or only one gun 122. The sets 126 and/or the guns 122, themselves, can be separated by one or more spacers 128 to facilitate placing the perforations formed by the guns at specified axial locations.

FIG. 1 shows the guns 122 as being unidirectional, in that all explosive charges 124 of a gun 122 are aligned to fire in the same trajectory. Each of the three guns 122 in a set are arranged to fire, and thus form perforations, in a different trajectory. In other instances, a single gun 122 can have explosive charges 124 that fire in multiple trajectories, so that one gun 122 can fire in the different trajectories. Alternately, some or all guns of a set 126 can be arranged to fire in the same trajectory.

Figure 2:
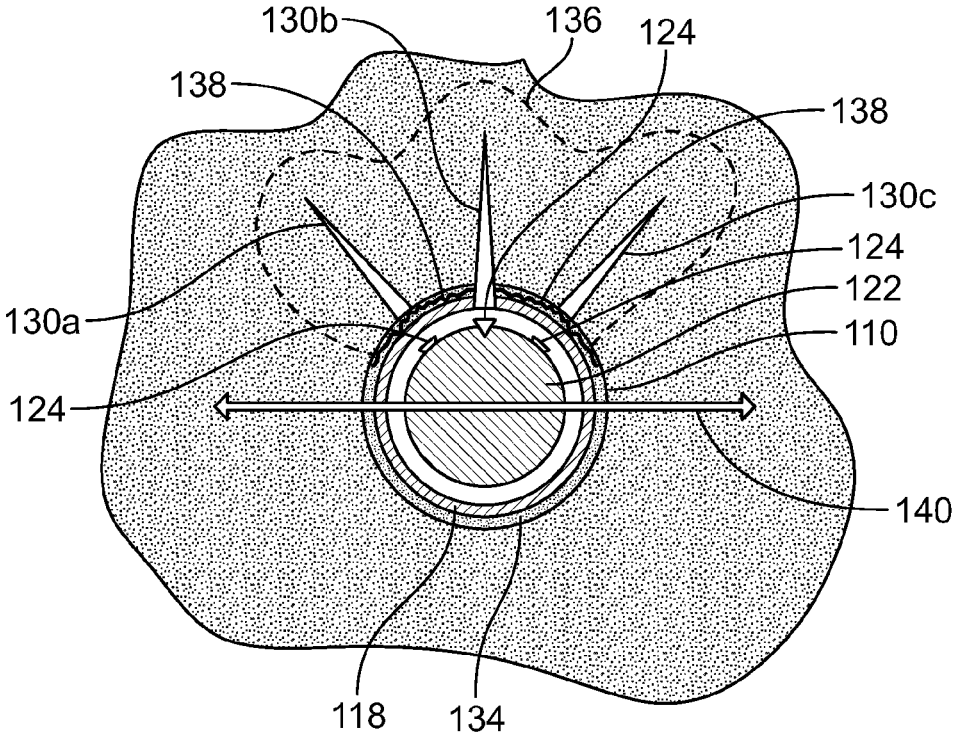
FIG. 2 is an axial cross-sectional view looking downhole after perforating the well.
Figure 3:
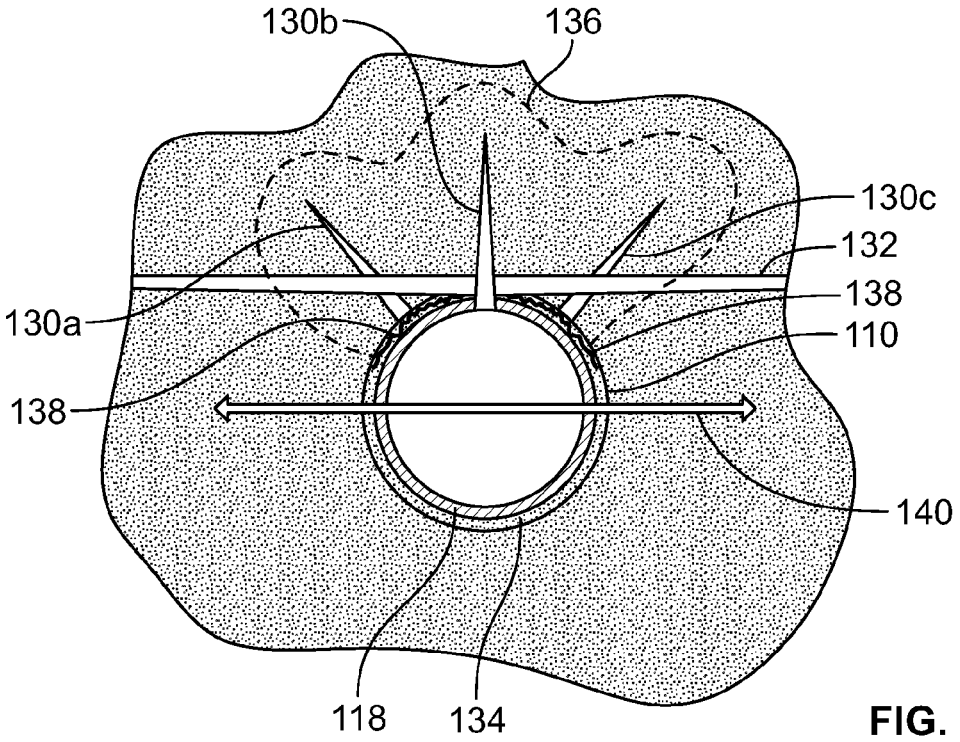
FIG. 3 is the same cross-sectional view as FIG. 2, but after a fracture treatment has been performed on the well.

In completing the well 100, the wall of the wellbore 110 will first be perforated and then a fracture treatment will be performed through the perforations. FIG. 2 is an axial cross-sectional view looking downhole after operating the perforating guns 122 to form perforation tunnels 130*a-c* extending through the wall of the wellbore 110 and into the subterranean zone 116. FIG. 3 is the same cross-section after a fracture treatment (with the perforating string removed) and showing a fracture 132 formed by the treatment.

Discussing the fracturing treatment first, typically, the perforating string 120 is removed from the wellbore 110 and a fracturing injection string is run into the wellbore 110. An interval of the wellbore 110 encompassing the subterranean zone 116 is sealed off using one or more packers carried in the fracturing injection string. Thereafter, high volumes of high pressure fracturing fluid are pumped through the fracturing injection string and into the sealed off interval of the wellbore 110. The fracturing fluid flows out of the wellbore 110 and into the subterranean zone 116 through the perforations 130, causing the rock of the subterranean zone 116 to expand and fracture. The fracturing fluid can be pumped in one or more stages. After fracturing, the fluid is eventually drained off and the pressure released. In certain instances, one or more of the fracturing stages can include particulate, referred to as proppant, that enters the rock with the fracturing fluid and is deposited in the fractures to prop the fractures open after the pressure of the fracturing fluid is released.

The fracture treatment forms a primary fracture 132 in the rock that, if other secondary fractures are present (e.g., pre-existing natural fractures, dendritic fractures and/or other secondary fractures), is the largest fracture in terms of fracture volume and extent from the wellbore 110 into the subterranean zone 116. The primary fracture 132 extends in a thin, three dimensional blade, outward from the wellbore 110 in opposing directions along a direction of primary fracture propagation 140. Subject to local discontinuities, the direction of primary fracture propagation 140 is dictated by the properties of the rock of the subterranean zone 116 and tends to substantially correspond to the direction of maximum stress in the rock. In certain instances, the direction of maximum stress can be determined by determining the slope of the formation of the subterranean zone 116, because the direction of maximum stress typically runs perpendicular to the downward slope of the formation of the subterranean zone 116, provided it is not close by to a compressional fault line. The slope of the formation can be determined by reviewing a topographical map of the formation.

In perforating the wall of the wellbore 110 (which, as noted above, is performed before fracturing), the perforating guns 122 are operated to detonate their explosive charges 124. In an example of shaped charges, the charges 124 ignite and generate an explosion that is shaped by the charge carrier and directed toward the wall of the wellbore 110.

The force of the explosion hits the wall of the wellbore 110 at a very high force/pressure, in certain instances, exceeding 3 million psi. In forming the perforations 130*a-c*, the force/pressure and high heat of the explosion melts and moves the casing 118, the cement 134, and the rock of the subterranean zone 116 near the wellbore 110 away. As a result, the rock of the subterranean zone 116 is compacted, creating a very highly stressed region 136 (i.e., a local stress discontinuity) around the perforation tunnels 130*a-c*. Because of the high rock stresses, the region 136 is more difficult to fracture than the surrounding rock, and thus, any subsequently formed fractures will tend to form around the region 136 rather than extend through the region 136. The portions of the casing 118 surrounding, and in certain instances spanning between, the perforations 130*a-c* also move outward, causing the cement 134 to crack, forming circumferential cracks 138 around the casing 118. While any primary fracture formed by the fracturing treatment will ultimately extend in the direction of primary fracture propagation, the circumferential cracks 138 will be local discontinuity that will likely be the start of and dictate the initial direction of the fracture.

Rather than extending in the direction of primary fracture propagation, a fracture formed from a perforation directed into the direction of primary fracture propagation will initially extend transverse to the direction of primary fracture propagation. This is, in part, because the fracture will tend to initiate through the circumferential cracks 138 in the cement 134 which, in the region around a perforation in the direction of primary fracture propagation, are generally transverse to the direction of primary fracture propagation. Additionally, the highly stressed region 136 formed around the perforation tunnel is located in the direction of primary fracture propagation. Therefore, the fracture will tend to deviate transverse to the direction of primary fracture propagation to propagate around the highly stressed region 136. Eventually, after propagating around the highly stressed region 136, the fracture will change direction and, for the remainder of its growth, tend to propagate in the direction of primary fracture propagation. However, the fracture's initial extent transverse to the direction of primary fracture propagation causes a tortuosity formed in the flow path between the majority of the fracture and the wellbore. Not only does this tortuosity act as an impediment to flow, if the imperfection is between 70-110° degrees from the direction of primary fracture propagation, then opening the fracture faces will not significantly open the majority of the fracture. For example, if fluid is pumped into this opening, then high velocities will develop in the fracture, causing low pressures that tend to suck it closed. If the fluid contains proppant, this proppant is going to plug the fracture even more, and cause screenout. Additionally, other adjacent perforations that are formed into the direction of primary fracture propagation will be generally parallel to the majority of the fracture. Thus, they may not cross, and thus may not fluidically connect with the fracture other than through the permeability of the intervening rock.

Figure 4:
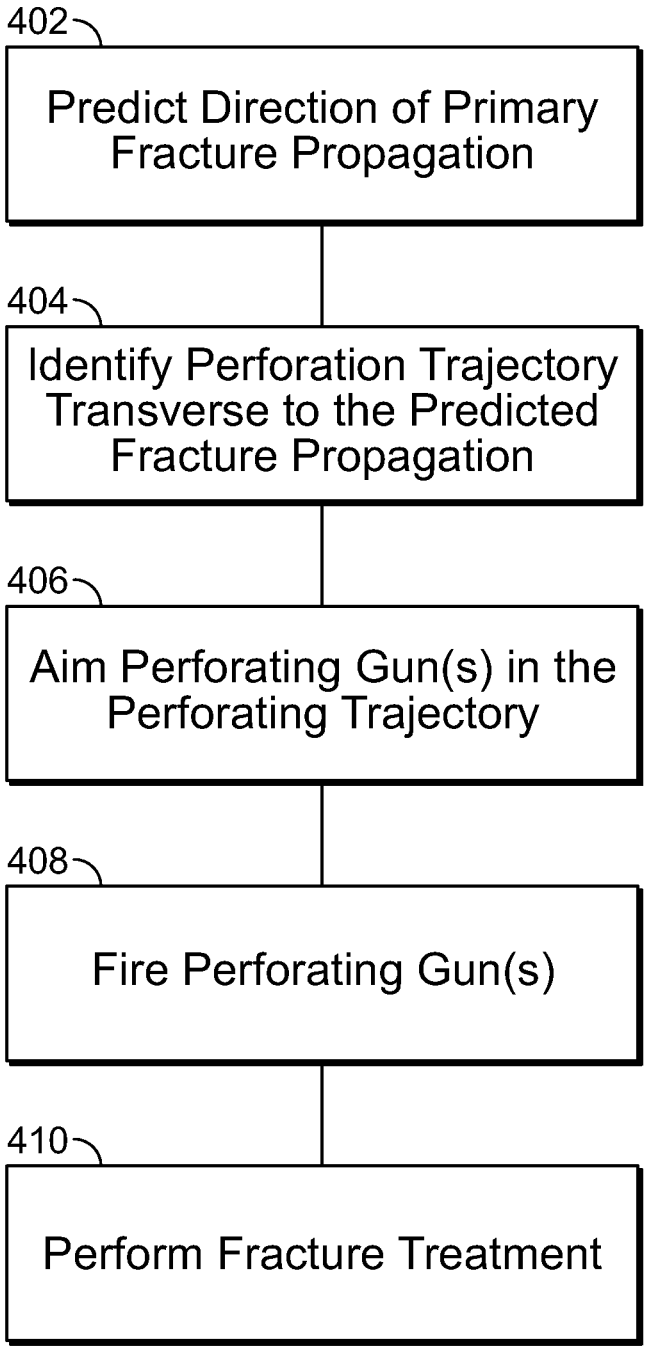
FIG. 4 is a flow chart of an example method.

Accordingly, the wellbore can be perforated in a manner that accounts for the near wellbore damage that occurs during perforating to reduce, or in certain instances eliminate, tortuosity in fractures subsequently formed through the perforations. To this end, referring to FIG. 4, the direction of primary fracture propagation is predicted at operation 402. For example, as discussed above, the direction of primary fracture propagation can be predicted as being in the direction of maximum stress in the rock and/or perpendicular to the downward slope of the formation of the subterranean zone 116.

At operation 404, a perforation trajectory is identified that is transverse (perpendicular or crossing at a steep angle) to the predicted direction of primary fracture propagation in the subterranean zone 116. For example, a person or computer, remote or at a well site, can receive information indicating the predicted direction of primary fracture propagation and identify a perforation trajectory based on this information. In certain instances, the transverse trajectory can be precisely perpendicular, within the ability of the operator to orient the perforating gun, to the direction of primary fracture propagation. In certain instances, the transverse trajectory can be at a steep or acute angle from precisely perpendicular to the direction of primary fracture propagation. In certain instances, the transverse trajectory can be within 45° (e.g., within 40°, within 30°, within 15°, within 5°, and/or at another angle) of the predicted direction of primary fracture propagation. In certain instances, the transverse trajectory can be in the direction of minimum stress of the subterranean zone. Also, at operation 404, two or more perforation trajectories may be identified, for example, if perforations will be formed in different trajectories. For example, in FIG. 3, three perforation trajectories were identified for the depicted interval of the well. In instances where more than one interval of the well will be perforated, the same or one or more additional perforation trajectories may be identified for the other interval(s).

Notably, the perforating trajectories can leave a portion of the wellbore un-perforated by the perforating guns. For example, the perforating trajectories can leave, un-perforated or intact, the portions of the wellbore in a direction coinciding (precisely or substantially) with the predicted direction of primary fracture propagation. In other words, the perforating trajectories may be only transverse to the predicted direction of primary fracture propagation. Also, the wellbore need not be perforated symmetrically, so as to have perforations on opposing walls of the wellbore. Thus, the perforating trajectories may leave the wellbore un-perforated substantially opposite to the perforations formed in the perforation trajectory.

At operation 406, the perforating gun(s) in the perforating string are aimed to perforate in the identified perforation trajectory, and at operation 408 the perforating gun(s) are fired to perforate the wall of the wellbore in the perforation trajectory. If multiple perforating guns are used, all of the guns and/or all of the guns in a set can be fired concurrently or simultaneously or the guns can be fired at different times. In an instance where all perforations will be formed in a single trajectory, the perforating string is oriented with the explosive charge(s) of the perforating gun(s) in the single trajectory. In an instance where perforations will be formed in multiple trajectories, the perforating string can be aimed with its gun (s) in a first perforation trajectory, explosive charge(s) fired to perforate, then aimed with its gun(s) in a second perforation trajectory, and other explosive charge(s) fired to perforate, and so on until perforations have been formed in the multiple perforation trajectories. Alternately, or in combination with that above, the perforating string can be assembled with the perforating guns oriented to perforate in multiple trajectories without re-aiming the perforating string. For example, the string can be positioned once with one perforating gun aimed to perforate in a trajectory transverse to the predicted direction of fracture propagation, and other perforating guns aimed to perforate in trajectories transverse to the predicted direction of fracture propagation and on the same or opposing sides of the first perforating gun's trajectory. In certain instances, the guns of a particular set of guns can be arranged in a center-left-center-right arrangement (and variations thereof) or another arrangement. Notably, as described above, the perforating will likely form cracks or fractures in the cement between the rock and the casing, that initially extend transverse to the predicted direction of fracture propagation, as well as a highly stressed region of the rock in the predicted direction of fracture propagation.

At operation 410, a fracturing treatment is performed on the well, as described above, by pumping high volume, high pressure fracturing fluid (and, in certain instances, proppant) through the perforations and into the rock of the subterranean zone. The resulting primary fracture will propagate from the perforation tunnels, outward into the rock of the subterranean zone, likely directly in the predicted direction of primary fracture propagation. As best seen in FIG. 3, to the extent that the circumferential cracks 138 in the cement 134 influence the primary fracture's 132 propagation, they will tend to operate as a secondary, pre-fracture that directs the primary fracture 132 into the predicted direction of primary fracture propagation 140, because the cracks 138 in this region are generally directed into the direction of primary fracture propagation 140. Additionally, to the extent that the highly stressed region of the rock 136 formed by perforating (e.g., region 136 of FIG. 3) influences the primary fracture's 132 propagation, it too will tend to direct the primary fracture 132 into the predicted direction of primary fracture propagation 140 as the primary fracture 132 tends propagate away from the highly stressed region 136. The resulting primary fracture 132 will be substantially planar, extending in a single direction (i.e., the direction of primary fracture propagation) and connect to the wellbore without tortuosity. Finally, the perforations 130*a-c* formed transverse to the predicted direction of fracture propagation 140 have a greater fluidic connection to the primary fracture 132, because the perforations 130*a-c* extend through the plane of the fracture 132, itself. In other words, fluid can be communicated between the wellbore 110 and the primary fracture 132 (e.g., during production/injection) through the relatively large flow area of the perforations 130 themselves, rather than solely through the permeability of the intervening rock or any connecting secondary fractures.

A number of implementations have been described. Nevertheless, it will be understood that various modifications may be made. Accordingly, other implementations are within the scope of the following claims.

What is claimed is:

1. A method of stimulating a subterranean zone surrounding a well bore, the method comprising:

identifying a perforation trajectory that is transverse to a predicted direction of primary fracture propagation in the subterranean zone;

aiming a perforating gun in the well bore to perforate in the perforation trajectory;

initially perforating the well bore in the perforation trajectory to form a first perforation; and initiating a first fracture from the first perforation that propagates in the predicted direction of primary fracture propagation.

2. The method of claim 1, where perforating the well bore comprises perforating the well bore with a perforating gun comprising one or more of a shaped charge or a projectile.

3. The method of claim 1, where the perforation trajectory is less than 45° from perpendicular to the predicted direction of primary fracture propagation.

4. The method of claim 1, further comprising leaving the well bore un-perforated in a direction substantially coinciding with the predicted direction of primary fracture propagation in the subterranean zone.

5. The method of claim 1, further comprising leaving the well bore un-perforated substantially opposite the perforation in the perforation trajectory.

6. The method of claim 1, where aiming a perforating gun in the well bore to perforate in the perforation trajectory comprises aiming a perforating gun in the well bore to perforate into the direction of minimum stress in the subterranean zone.

7. The method of claim 1, where the perforation trajectory is perpendicular to the predicted direction of primary fracture propagation.

8. The method of claim 7, where the perforating gun comprises a first perforating gun, the method further comprising:

aiming a second perforating gun in the well bore to perforate in a second perforation trajectory that is less than 45° from perpendicular to the predicted direction of primary fracture propagation; and perforating the wellbore in the second perforation trajectory to form a second perforation.

9. The method of claim 8, further comprising initiating a second fracture from the second perforation that propagates in the predicted direction of primary fracture propagation.

10. The method of claim 8, where the first and second perforating gun are in the same string and aiming the first and second perforating guns are performed simultaneously.

11. The method of claim 8, further comprising:

aiming a third perforating gun in the well bore to perforate in a third perforation trajectory that is less than 45° from perpendicular to the predicted direction of primary fracture propagation and on an opposing side of the first mentioned perforation trajectory from the second perforation trajectory; and perforating the well bore in the third perforation trajectory to form a third perforation.

12. The method of claim 11, further comprising:

performing a fracturing treatment on the subterranean zone to form a fracture substantially following the predicted direction of primary fracture propagation; and depositing proppant into the fracture through perforations formed in the first mentioned, second and third perforation trajectory.

13. The method of claim 12, where depositing proppant into the fracture comprises depositing proppant into the fracture to allow the fracture to contract adjacent the well bore and filter against production of proppant from the fracture.

14. The method of claim 8, wherein the first and second perforating guns are part of a perforating gun set.

15. The method of claim 8, wherein the first and second perforating guns are the same perforating gun.

16. The method of claim 1, where aiming a perforating gun in the well bore to perforate in the perforation trajectory comprises aiming at least one charge of the perforating gun in the well bore to perforate in the perforation trajectory; and where perforating the well bore in the perforation trajectory comprises perforating the well bore in the perforation trajectory and at least one other trajectory within 45° of the predicted direction of primary fracture propagation.

17. A well bore system in a subterranean zone, comprising:

a first perforation in a wall of the well bore and within the subterranean zone, the trajectory of the first perforation being transverse to a direction of primary fracture propagation;

the wall of the well bore within the subterranean zone being un-perforated in a region coinciding with the direction of primary fracture propagation in the subterranean zone; and a fracture in the subterranean formation formed by fracture treatment through the first perforation and extending in the direction of primary fracture propagation.

18. The well bore system of claim 17, where the trajectory of the perforation is perpendicular to the direction of primary fracture propagation.

19. The well bore system of claim 18, further comprising second and third perforations on opposing sides of the first mentioned perforation, the perforation trajectory of the second and third perforations are less than 45° from perpendicular to the direction of primary fracture propagation.

20. A method, comprising:

targeting a perforating device to initially perforate a subterranean well bore in a direction substantially perpendicular to an expected fracture direction and operating the perforating device to form the initial perforation; and fracturing a subterranean zone around the well bore through the initial perforation to form a fracture that extends in the expected fracture direction.

21. The method of claim 20, further comprising targeting a second perforating device to perforate the well bore within 45° of perpendicular to an expected fracture direction and operating the second perforating device.

22. The method of claim 21, where the first, second and third perforating devices comprise a first set of perforating devices; and where the method further comprises targeting and operating a second set of perforating devices.

23. The method of claim 20, further comprising targeting a third perforating device to perforate the well bore within 45° of perpendicular to an expected fracture direction and on an opposite side of the perpendicular than the second perforating device.

24. The method of claim 20, further comprising leaving the well bore un-perforated in a direction substantially aligned with the expected fracture direction.

* * * * *

UNITED STATES PATENT AND TRADEMARK OFFICE

CERTIFICATE OF CORRECTION

PATENT NO. : 9,068,449 B2
APPLICATION NO. : 13/622086
DATED : June 30, 2015
INVENTOR(S) : Jim B. Surjaatmadja It is certified that error appears in the above-identified patent and that said Letters Patent is hereby corrected as shown below:

In the claims, Column 6, Line 34, replace "claim 1" with -- claim 4 --

Signed and Sealed this
Eighth Day of December, 2015

Michelle K. Lee

Michelle K. Lee
*Director of the United States Patent and Trademark Office*